United States Patent [19]

Kyle, Jr.

[11] 3,986,270

[45] Oct. 19, 1976

[54] APPARATUS FOR CONTINUOUSLY DRYING SEPARATE CHARGES OF MATERIAL WHILE MAINTAINING THE CHARGES SEPARATE

[76] Inventor: Henry E. Kyle, Jr., 7639 Beechnut No. 16, Houston, Tex. 77036

[22] Filed: May 23, 1975

[21] Appl. No.: 580,172

[52] U.S. Cl. ..... 34/52; 34/172; 222/426

[51] Int. Cl.[2] ..... F26B 17/12

[58] Field of Search ..... 34/172, 178, 194, 237, 34/52, 56; 222/426, 429, 431, 450; 302/62

[56] References Cited

UNITED STATES PATENTS

| | | | |
|---|---|---|---|
| 92,096 | 6/1869 | Rhodes | 34/178 |
| 272,959 | 2/1883 | Hoyt | 34/172 |
| 794,313 | 7/1905 | Rice | 34/172 |
| 1,834,497 | 12/1931 | Oxer | 34/172 |

FOREIGN PATENTS OR APPLICATIONS

| | | | |
|---|---|---|---|
| 111,112 | 1/1919 | United Kingdom | 34/172 |

*Primary Examiner*—John J. Camby
*Assistant Examiner*—Larry I. Schwartz
*Attorney, Agent, or Firm*—Jack W. Hayden

[57] ABSTRACT

A plurality of members are arranged in side by side relation to form a plurality of horizontal rows, vertically stacked in a vertical drier. Movable means are associated with selected rows of the members and are movable to form a floor to separate one part of the drier from another part so as to maintain loads of material moving through the drier separate as the material is being dried. Means are provided to actuate the movable means in a predetermined sequence to stepwise form a floor from the top to the bottom of the drier whereby loads of material in the drier are maintained separate as they are moved through the drier.

9 Claims, 14 Drawing Figures

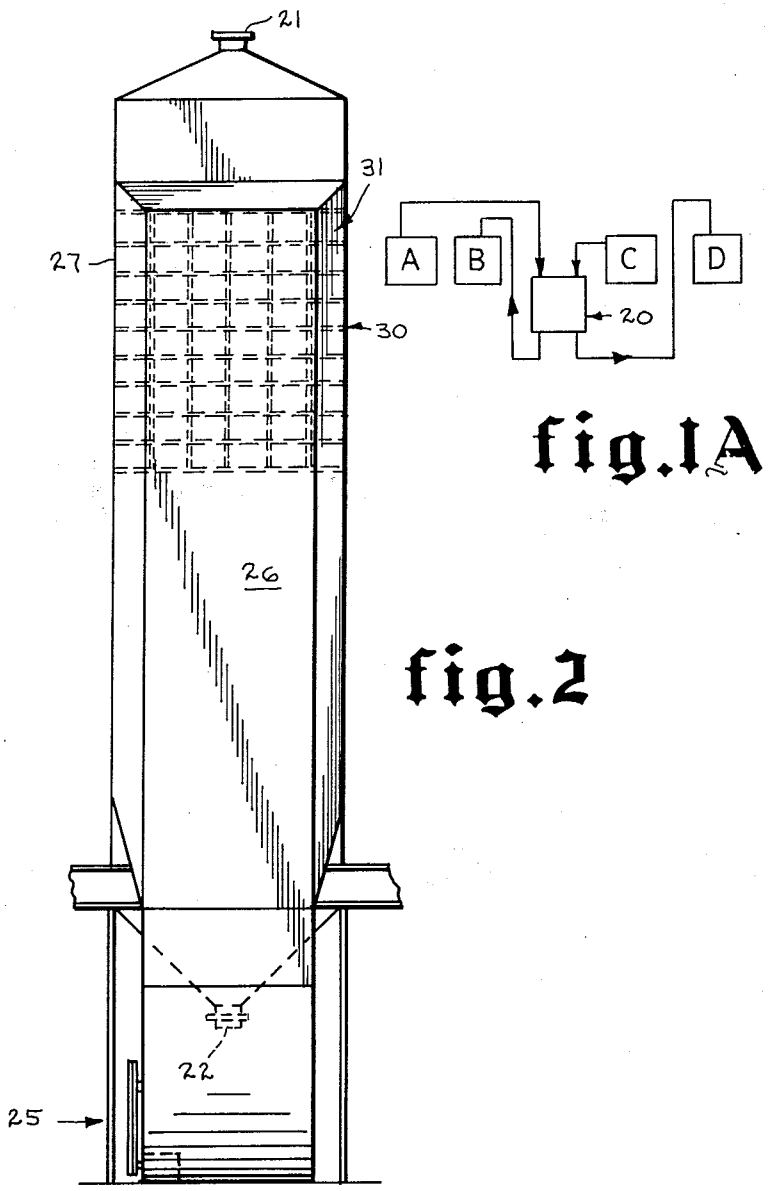
fig. 1A
fig. 2
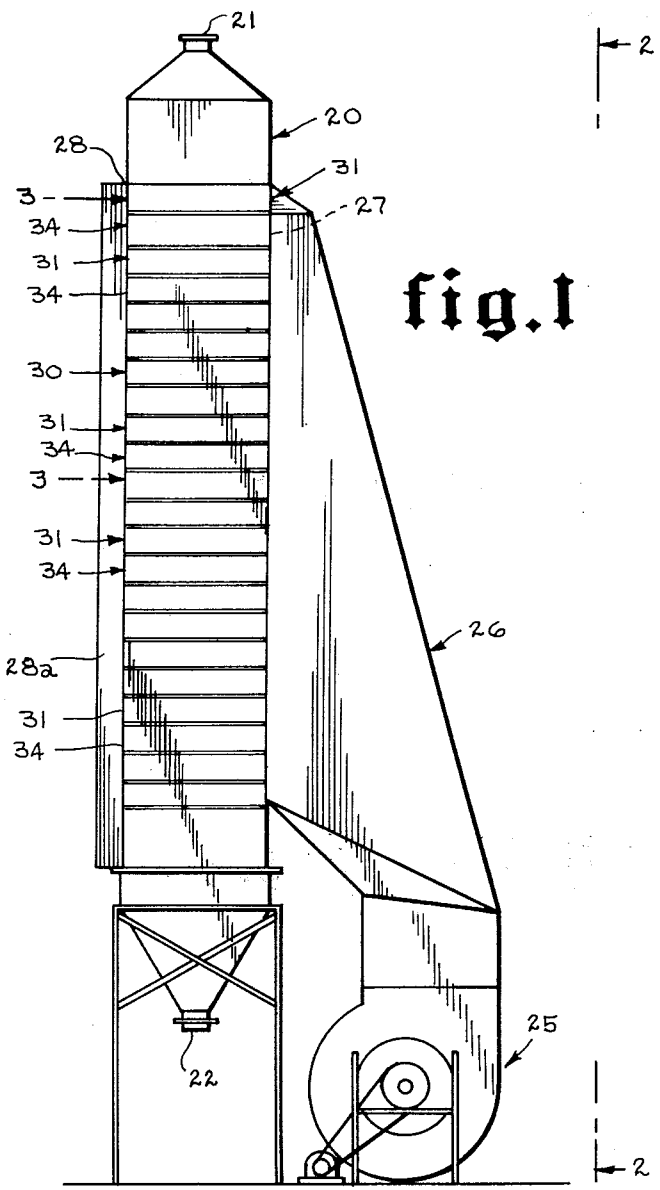
fig. 1

APPARATUS FOR CONTINUOUSLY DRYING SEPARATE CHARGES OF MATERIAL WHILE MAINTAINING THE CHARGES SEPARATE

SUMMARY OF THE INVENTION

In drying material, such as grain, at the present time, a drier is filled with the material from a bin. The fire is lighted and the discharge from the drier is started and the grain at the bottom of the drier is rotated to the top of the drier, all of the foregoing in a manner well known in the art.

After about 15 minutes, the grain begins to dry and is discharged to a bin prepared to receive the dried grain. As grain is fed from a bin into the top of the drier, it is then passed down through the drier and discharged to a receiving bin for storing the dried grain or material. After all of the material from the bin has been discharged into the drier for drying thereof, the last portion of the grain from the bottom of the drier is again rotated to the top of the drier for approximately 15 minutes and is then discharged to the receiving bin.

The fire is cut off and the drier is dumped. When the drier is empty, it is then set up and the above procedure is repeated from grain received from still another bin. The grain from this bin in turn is discharged yet to a separate storage bin from the first storage bin which received the dried material from the grain so as to maintain separate each charge of grain moving through the drier.

In the method and apparatus of the present invention, a drier is filled from a bin and the fire is lighted. The drier discharge is started and the grain at the bottom of the drier is rotated to the top of the drier for approximately 15 minutes and as the grain begins to dry it is discharged to a bin. Grain is fed from a bin into the top of the drier, it is then passed through the drier and discharged to the receiving bin until all the grain from the first bin is emptied through the drier and into the receiving bin.

When all of the grain from the first bin has been emptied, suitable indication means, such as audible alarm or the like, is rigged in a well known manner to indicate such fact and signals to the operator of the drier to manually start the method and apparatus of the present invention.

The present invention comes into operation when the level of the grain in the drier from the first receiving bin is at a predetermined level adjacent the upper end thereof.

The present invention functions to initially form a floor or deck adjacent the top of the drier so that grain from another bin may be received thereon, and which floor separates the grain from the second bin from the grain being moved through the drier from the first bin mentioned above.

As the first charge of grain continues to move through the drier, the absence of such grain at various vertical levels in the drier is instrumentally noted. This cooperates with other means to cause the present invention to form a next lower floor or deck immediately below the initially formed floor adjacent the top of the drier and to thereafter open the initially formed floor so as to dump the grain from the second bin retained in the drier on the initially formed floor or deck onto the second floor.

Thus, movement of the first charge of grain and the second charge of grain continues through the drier and both are dried simultaneously while maintaining them separate. The charges of grain in the drier serve to maintain a seal therein so that proper drying of the grain can be accomplished. The first charge of grain is discharged to its receiving bin after it has moved through the drier, and the second charge of grain is discharged to its bin after moving through the drier.

When all of the grain from the second bin has been discharged to the drier, this fact is again signalled by means of an audible alarm or the like, so that the operator may then immediately start the flow from still a third bin to the drier for drying thereof. The material from the third bin is initially discharged into the drier when the level of grain or material from the second bin is below a predetermined level at the upper end of the drier. This fact is signalled again to the present invention, and the present invention then functions to sequentially form floors and to open such floors after a floor has been formed immediately therebeneath so that a third charge of grain or material is moved through the vertical drier for drying thereof while maintaining it still separate from the second charge.

This procedure may be continued as long as necessary for drying as many different charges of grain simultaneously, while maintaining each charge of grain or material in the drier separate and thereby preventing commingling thereof.

An object of the present invention is to provide a method and arrangement for drying separate charges of grain whereby the separate charges may be simultaneously dried in a vertical drier without commingling thereof.

Yet a further object of the present invention is to provide a method of apparatus for separating a plurality of charges of material to a drier as the material is moved vertically through the drier so as to separate each charge of material from another charge while continuously drying the charges of materials.

Yet a further object of the present invention is to provide an arrangement for continuously drying different batches of materials simultaneously while maintaining the integrity of the batches.

Still another object of the present invention is to provide an arrangement for drying separate batches of grain while maintaining the batches separate and continuously charging the drier with separate batches in a sequential manner to more efficiently and economically dry grain batches.

Other objects and advantages of the present invention will become more readily apparent from a consideration of the following description and drawings.

BRIEF DESCRIPTION OF THE DRAWINGS

FIG. 1 is a side view of a vertical drive illustrating schematically the present invention positioned therein;

FIG. 1A is a diagrammatic view illustrating a vertical driver and a plurality of bins for discharging grain to the drier of FIG. 1 with a plurality of bins for receiving dried grain from the drier;

FIG. 2 is a side view of the drier on the line 2—2 of FIG. 1 illustrating the blower and plenum arrangement for discharging heated air from the blower and plenum to the drier;

DESCRIPTION OF THE PREFERRED EMBODIMENTS

Figure 4:
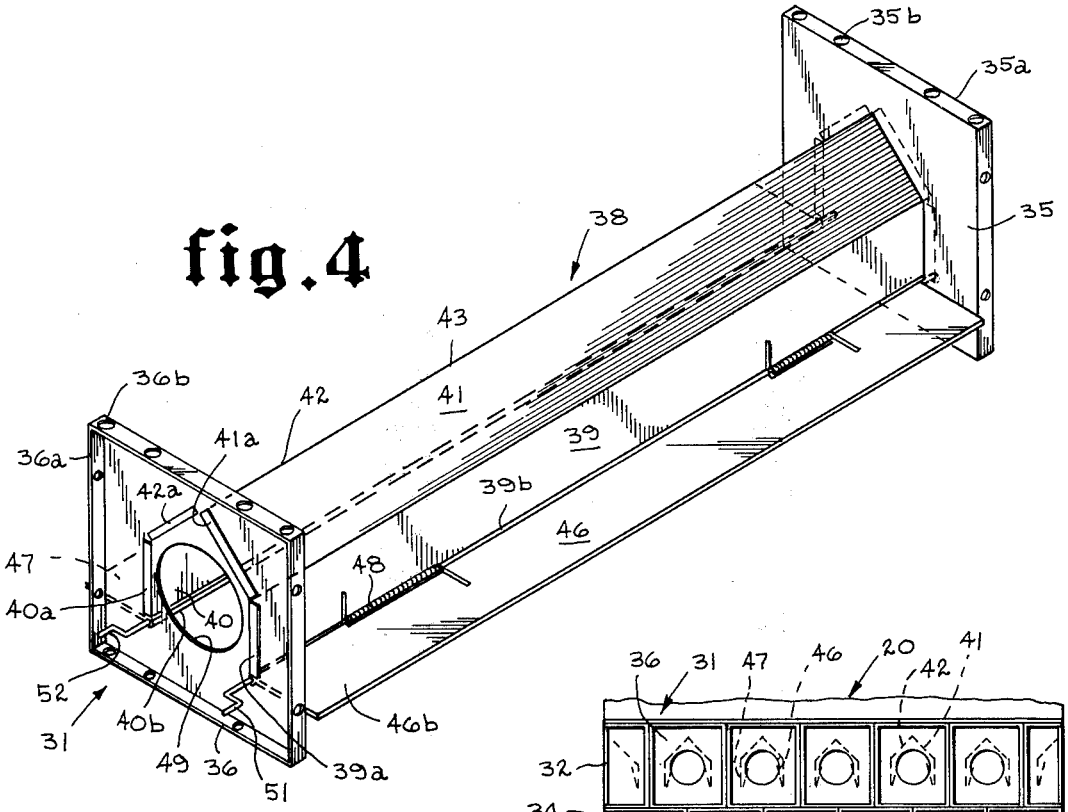
FIG. 4 is an enlarged isometric view showing one form of an arrangement which may be employed for sequentially forming a plurality of trays or floors throughout the vertical extent of the drier to separate batches of grain or other material moved progressively through the drier.

Attention is first directed to 1A of the drawings wherein a vertical drier is represented generally by the numeral 20. In present procedures familiar to applicant, where a material such as grain is to be dried in the vertical drier 20, it is filled with grain from a bin such as bin A. The drier is ignited in a manner well known in the art and the discharge from the drier is initiated in a manner well known in the art and the grain at the bottom of the drier is rotated to the top of the drier in a manner well known in the art.

After approximately 15 minutes the grain begins to dry and is discharged from the drier 20 to the bin B as schematically represented in FIG. 1A. Grain from bin A is fed continuously to the top of the drier 20 and is then passed downwardly through the drier and discharged to bin B. When bin A empties, the grain from the bottom of drier 20 is rotated to the top of the drier in a manner well known in the art for approximately 15 minutes and is then discharged to receiving bin B.

The fire in drier 20 is then cut off and the drier is dumped. When the dryer is empty, the procedure is repeated from another bin such as that represented at C.

In this manner separate lots of grain are maintained separately so as to prevent commingling in the drier 20.

Various controls are employed in connection with drier 20 which are well known to those skilled in the art to control the rate and the amount of drying of the grain as well as the rate of discharge from the drier 20 which form no part of the present invention. Also, in order to effectively dry grain, the drier 20 should maintain an operating seal, that is, the drier must be full of grain during drying thereof.

In FIG. 1 a drier 20 is again referred to, and is shown as being vertically disposed with an opening 21 at the upper end for receiving a substance such as grain and a discharge 22 at the lower end thereof. A combination heater and blower arrangement referred to generally at 25 of well known construction conducts heated air through the plenum referred to at 26 for discharge into the vertically arranged drier 20 for heating the grain.

In this connection, it should be noted that the present invention is described in detail in connection with its use to dry grain; however, such description is for purposes of illustration only and is not intended as a limitation, as it can be appreciated that the present invention may be employed to dry any substance or groups of substances where it is desired to continuously dry the substances and maintain the batches or groups of substances segregated or separated to thereby inhibit commingling or mixing.

As illustrated generally at 30 in FIG. 1, it should be noted that the vertically disposed drier 20 is provided with an arrangement so that a plurality of horiziontal rows of flooring, or decks, may be formed at longitudinal, vertical intervals in the vertical drier 20 to control movement of the grain therethrough as it is dried and to maintain the grain batches separated in a manner as will be described in greater detail.

Figure 3:
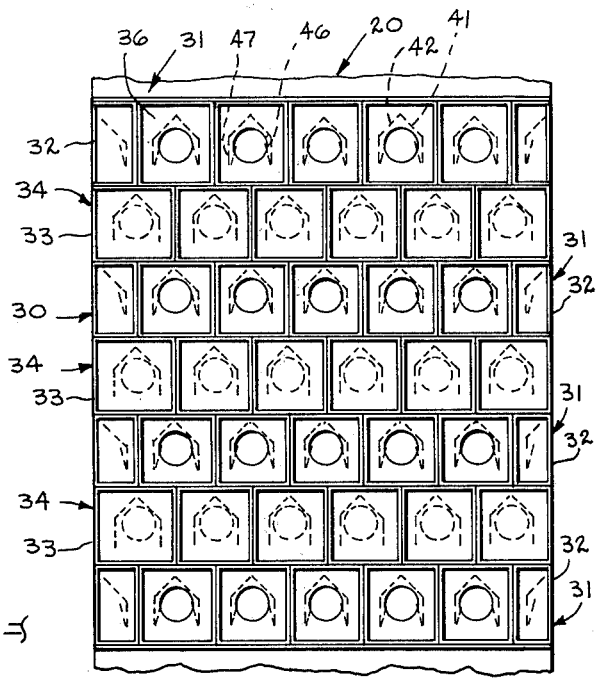
FIG. 3 is a partial sectional view on the line 3—3 of FIG. 1 illustrating further details of the arrangement of the present invention to enable a plurality of trays or floors to be sequentially formed in the drier to separate batches of material as they are dried and progressively moved through the drier.

FIG. 3 is a sectional view on the line 3—3 of FIG. 1 and shows a portion of the arrangement 30 in greater detail. The arrangement 30 shows a plurality of members referred to generally at 31 arranged in side by side relation and extending longitudinally and horizontally from the plenum entry represented at 27 in FIG. 1 to the exit 28 on the opposite side of the drier 20 as generally illustrated in FIGS. 1 and 2. The members 31 are arranged in side by side relation to form a horizontal row 32 in the drier 20. The rows 32 of members 31 are separated by the rows 33 of the members 34 arranged also in side by side relation and extending longitudinally and horizontally from the plenum inlet 27 to the plenum discharge represented at 28 on the opposite side of the drier 20 so as to position the rows 32 of the members 31 in longitudinally spaced relationship throughout substantially the vertical extent of the drier 20 as diagrammatically illustrated in FIG. 1.

The members 31 each include the end plates 35 and 36 having edges 35*a* and 36*a* respectively with openings 35*b* and 36*b* respectively for receiving screws or other fasteners to enable the members 31 to be positioned in the drier 20. Secured to and extending between the end plates 35 and 36 is the housing referred to generally at 38. The housing 38 includes upwardly extending side plates 39 and 40 which are bent at a position spaced upwardly from their lowermost edges 39*b* and 40*b* to form the plate portions 41 and 42 which extend upwardly and inwardly to intersect at the apex 43. It can be appreciated that the plates 39 and 40 as well as the upwardly and inwardly extending plates 41 and 42 may be formed of one piece of material, such as metal or the like. Each of the portions 39, 40, 41 and 42 include projecting portions 39*a*, 40*a*, 41*a*, and 42*a* which fit through slots arranged in each of the end members 35 and 36 to correspond with the arrangement of the surfaces 39, 40, 41 and 42 so that the projecting portions 39*a*, 40*a*, 41*a* and 42*a* may be bent back as shown in FIG. 4 to thereby position the member 32 between the end members 35 and 36.

Pivotally secured along the lower edge 39*b* of the plate 39 and along the lower edge 40*b* of the plate 40 are the plates 46 and 47 respectively. The pivotal arrangement includes spring means 48 so that each plate 46 and 47 is normally urged inwardly of the housing 38 and between the plates 39 and 40 to assume the relationship better illustrated in dotted line in FIG. 3 and shown in full lines in FIG. 7 of the drawings.

The end member 36 is provided with an opening 49 therein between the plates 39 and 40 as better shown in FIG. 4, whereas the end member 35 is continuous and closes off the space between the side plates 39 and 40 also better shown in FIG. 4.

The members 34 which are positioned in side by side relation to form the horizontal row 33 between the horizontal rows 32 of members 31 are identical to the construction shown in FIG. 4 of the members 31 with the exception that the members 34 are not provided with the pivotally mounted side plates 46 and 47.

As shown in FIG. 3, the members 31 are positioned in the rows 32 so that the members 35 face the inlet 27 from the plenum 26, whereas, the members 34 are positioned between the rows 32 of members 31 face so that the opening 49 communicates with the plenum 26 in the drier 20. Thus, when heated air is discharged from the plenum 26, it passes into the opening 49 in the members 34 and is discharged generally downwardly and around housing 38 as represented by the arrows at 50 in FIG. 7 and then flows upwardly around the sides 39 and 40 and through the grain in the drier represented at G to flow upwardly and discharge through the row 32 of members 31 immediately thereabove. The heated air is then discharged through the opening 49 in the various rows 32 of members 31 and passes through the outlet 28 into the discharge housing 28*a* arranged vertically of the drier 20.

Figure 5:
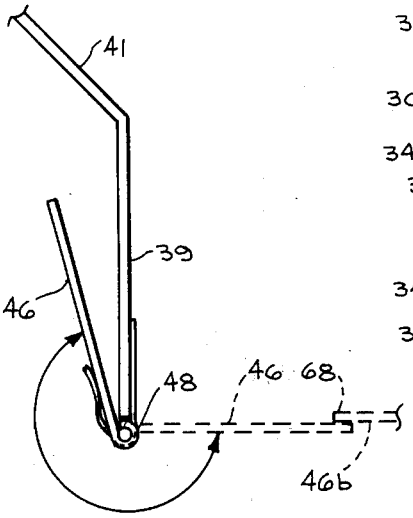
FIG. 5 is a fragmentary detail illustrating a portion of the arrangement when it is in open position in full line to enable material to pass therearound and down the drier and showing in dotted line the position which forms a tray or floor in the drier.

The pivotally mounted plates 46 and 47 are each provided with a crank 51 and 52 adjacent one end thereof to enable the pivotally mounted plates to be moved from the position shown in dotted line in FIG. 3 of the drawings (and from the solid line position shown in FIG. 5) to the dotted line position shown in FIG. 5 (shown in solid line in FIG. 4) so as to form a floor for receiving and supporting grain thereon as will be more fully described.

Figure 6:
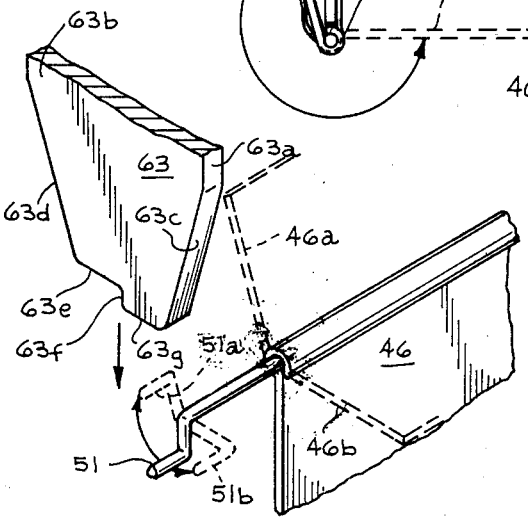
FIG. 6 is a fragmentary isometric view illustrating one manner of actuating the apparatus of the present invention to sequentially form a tray or floor in the drier of FIG. 1 for maintaining the grain or other material segregated as it moves through the drier, while permitting the floor or tray to open and sequentially enable the grain to be moved through the drier.

The movement of the pivotally mounted plates 46 and 47 is also illustrated in FIG. 6, and it will be noted that the end of the cranks 51 and 52 are aligned with the plane of their respectively pivotally mounted plates 46 and 47 and when the crank 51 is in the dotted line position illustrated at 51*a*, the plates 46 and 47 are in their innermost position within housing 38 as shown in dotted line in FIGS. 3 and 6 and when the plates 46 and 47 have been moved to a horizontal position so as to abut the next adjacent plates 46 and 47 to form a floor, the position of the crank is as shown at 51*b* and the position of the plate is shown at 46*b* in FIGS. 4–6 at such time.

It will be noted that a plurality of switch means 60 are arranged longitudinally within the drier 20 with each such switch means being positioned immediately beneath the row 32 of members 31, and the switch means 60 is of a suitable construction so that it reacts to pressure and will remain open so long as there is a volume of grain thereabove to exert pressure on such switch 60. Thus, in FIG. 10, it will be noted that the two uppermost switches 60 are shown as being closed to signify the absence of grain on the two uppermost rows 32 of members of 31, whereas the two lowermost pressure switches 60 are shown as being open with the grain being schematically represented at G and being present on the two lowermost pressure sensitive switches 60 and adjacent the two lowermost rows 32 of the members 31 shown in FIG. 10.

Figure 8:
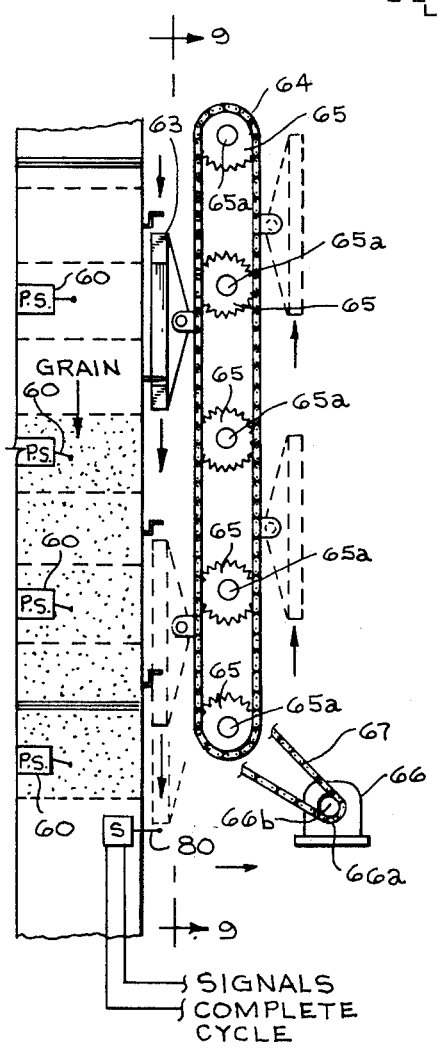
FIG. 8 is a partial fragmentary view illustrating one means for actuating the arrangement to sequentially form a floor and then open the floor formed by the next uppermost adjacent arrangement to dump the grain onto the closed floor whereby the grain may be sequentially moved through the drier while maintaining it separate from other charges of material in the drier.

The pressure sensitive switches 60 are also illustrated in FIG. 8 of the drawings.

Figure 7:
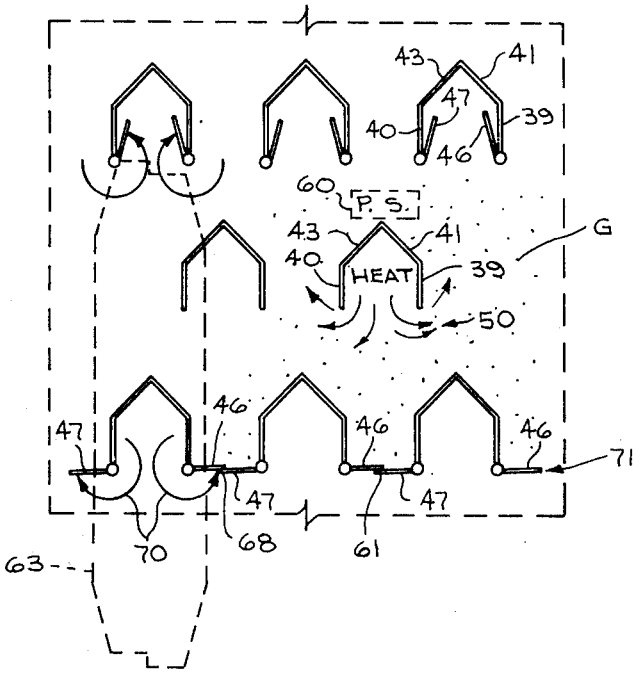
FIG. 7 is a fragmentary schematic view of the arrangement illustrating one manner of alternately actuating such arrangement to form a floor or tray and thereafter actuating the next uppermost arrangement for opening thereof to dump grain or other material onto the floor formed immediately therebeneath.
Figure 9:
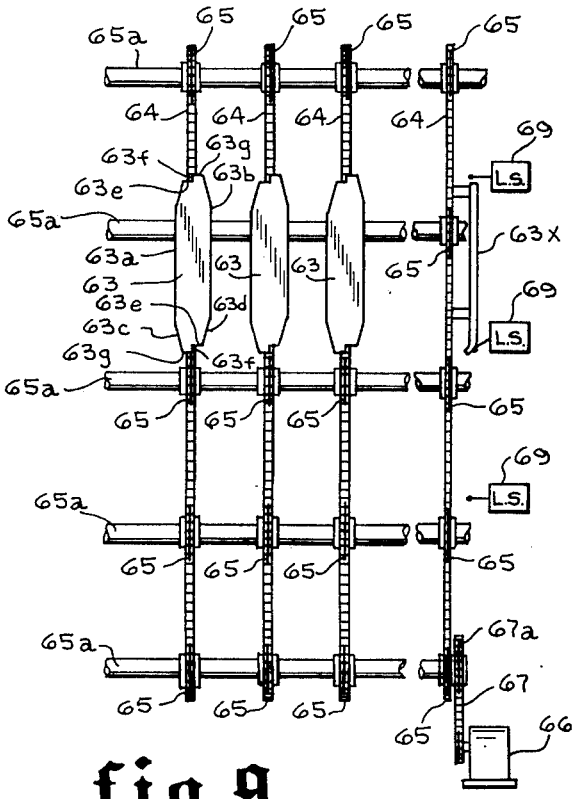
FIG. 9 is a partial side view on the line 9—9 of FIG. 8 illustrating in greater detail the arrangement for actuating the arrangement positioned in the drier to alternately and sequentially form a tray or floor therein while opening the next uppermost and previously formed tray or floor for dumping the grain or material onto the floor or tray therebeneath.

One arrangement for actuating the pivotally mounted plates 46 and 47, to sequentially form a floor or decking horizontally of the drier as represented in solid line at 61 in FIG. 7, is shown in FIGS. 8 and 9. Such means include the paddles or members 63 carried on the chains 64 which chains extend longitudinally of the drier 20 and are carried on suitable sprockets 65 as shown in FIGS. 8 and 9. The paddles or members 63 are each carried on a chain 64 which engages with the sprockets 65 on the vertically spaced and vertically aligned shafts 65*a*. The shafts 65*a* are rotatably supported in any suitable manner not shown. The members 63 extend longitudinally and have parallel sides 63*a* and 63*b*. Its lower end has tapered portions 63*c* and 63*d* with a recessed portion forming horizontal surface 63*e* and a longitudinal edge 63*f* which edge terminates at flat end surface 63*g*.

Suitable motor means as shown at 66 are connected to rotate the sprockets 65 and shafts 65*a* by means of the chain drive 67 and sprocket 67*a* for imparting movement to the chains 64 to cause the paddles 63 to move longitudinally of the drier 20 to engage the crank arms 51 and 52 and move such crank arms so as to position the plates 46 and 47 with which they are engaged from the innermost position between the plates 39 and 40 to a horizontal position in abutting relationship with the plates 46 and 47 of the members 38 which are arranged in side by side relation, such abutting relationship being illustrated at 68 in FIG. 5 in dotted line and in solid line in FIG. 7.

It can be appreciated that one paddle or member 63 will be required for each pair of the plates 46 and 47 on each of the housings 38 in the rows 32 and accordingly, depending upon the number of members 38 in each row 32 there will be a similar number of paddles 63 and supporting chains 64 which is partially illustrated in FIG. 9 and it will be noted that such members 63 are aligned horizontally in the same plane so that the crank arms 51 and 52 associated with each of the members 38 in each of the rows will be engaged and actuated simultaneously.

Figure 10:
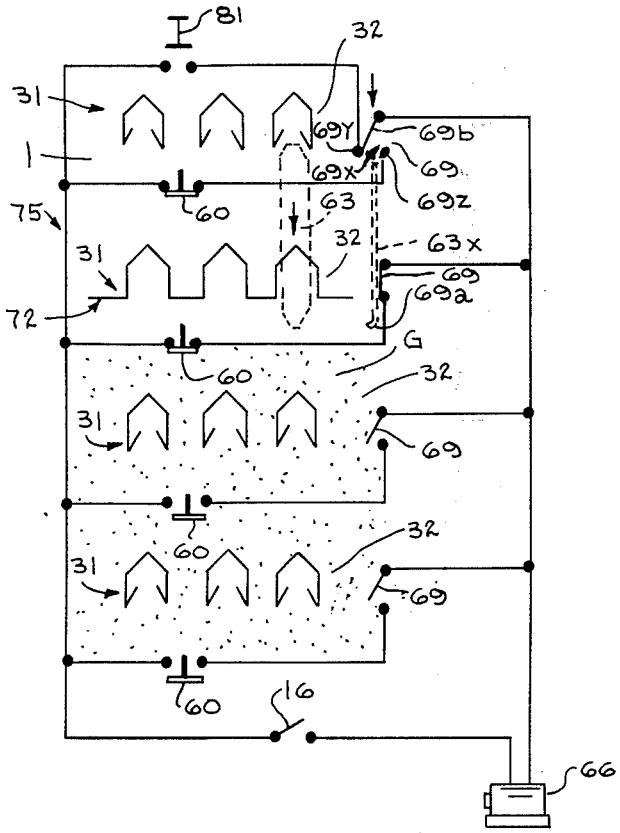
FIG. 10 is a partial diagrammatic sketch illustrating schematically a circuit which may be employed for actuation of the present invention.

Also arranged adjacent each of the rows 32 are limit switches 69 which are adapted to be sequentially engaged by the skid 63*x* on one chain 64 which is of the same longitudinal extent as the paddles or members 63 on each of their chains 64 as illustrated in solid line in FIG. 9 and dotted line in FIG. 10.

The skid 63*x* is also aligned longitudinally with the row or members 63 and it is carried on a chain 64 which is movably supported on sprockets 65 mounted on rotatable shafts 65*a*. It is mounted on chain 64 in a position so as to engage the limit switches 69 as it moves downwardly of the drier 20 along with members 63.

In FIG. 10, the electrical circuit is shown diagrammatically as are the rows 32 of members 31. The rows 33 of members 34 have been deleted for purposes of clarity.

The uppermost limit switch 69*b* is a double throw limit switch as illustrated at 69*x* in FIG. 10. The skid 63*x* is shown as having disengaged double throw switch 69*x* and it automatically reengages contact 69*y*. Skid 63*x* is shown also as having engaged the next lowermost limit switch 69*b*, and since there is no grain at this level pressure switch 60 is also closed, and thus with manual start switch 16 closed the circuit through such pressure switch 60 and the limit switch 69 at this level, the circuit to motor 66 is closed and this moves paddles 63 to actuate the plates 46 and 47 in the second level of the drier to form a floor as shown in FIG. 10. At the uppermost level, the members 46 and 47 are retracted since switch 69*b* is not engaged with contact 69*z*, even though the pressure switch 60 for that level is closed, and this circuit is interrupted to motor 66.

In operation of the present invention, the drier 20 is first filled with grain from bin A, and the drier lighted and the discharge drive initiated in the manner well known in the art and the grain at the bottom of the drier is rotated to the top of the drier for about 15 minutes to obtain proper drying thereof all in a manner well known in the art. By reason of controls well known in the art, as the grain begins to dry, it is simultaneously discharged from discharge opening 22 and into bin B as illustrated in FIG. 1A. The grain is continued to be discharged from bin A into the drier 20 until bin A empties, at which time a suitable alarm, such as an audible alarm is sounded signalling to the operator to manually start or initiate the function of the present invention.

As grain from bin A is dumped into the drier 20, the members 31 in all of the rows 32 are in the relationship illustrated in dotted line in FIG. 3 and at the top of FIG. 7 in solid line and will maintain such relationship until all of the grain from bin A has been discharged into the drier 20 whereupon alarm 15 sounds.

For purposes of description and explanation of the present invention, the uppermost area immediately beneath and adjacent the uppermost row 32 of members 31 having pivotally mounted plates 46 and 47 on each of the members 38 will be referred to as level 1 as shown in FIG. 10. When all of the grain from the first bin, which is designated bin A has been discharged into the drier 20, and when the grain from bin A has been recirculated as described previously to dry the grain sufficiently as determined by instruments in the drier 20 which function in a manner well known in the art, it begins to discharge from the drier and will eventually fall below the level 1 in the drier 20.

Pressure switch 60 at such uppermost level 1 then closes as diagrammatically illustrated in FIG. 10. At this time the paddles 63 are in contact with double throw limit switch 69*x* so that it is moved from contact 69*y* to engage contact 69*z*. The manual start switch 16 is closed when the alarm 15 sounds so that the circuit to motor 66 is closed through uppermost pressure switch 60 in level 1 and switch 69*x*. This causes the paddles 63 to continue to move downwardly.

The closing of manual start switch 16 initiates a cycle. That is, the grain from the first bin, bin A has been emptied into drier 20 and now begins to discharge therefrom. Therefore, grain from another bin may begin discharging into drier 20, before the first bin batch has been completely discharged from the drier 20. The closing of switch 16 starts members 63 to move downwardly by rotating chains 64, whereupon crank arms 51 and 52 of the plates 46 and 47 of each of the members 31 in the top row 32 at level 1 are pivoted to a horizontal position to engage the next adjacent plates 46, 47 and form a floor. Limit switch 69*x* maintains engagement with contact 69*z* to maintain the floor formed by plates 46, 47 in level 1. When the uppermost floor is formed by plates 46, 47 in the drier, a circuit is completed to a control panel which by light or other means indicates such condition. The operator manually opens anther bin and suitable conveying means carries the grain to the upper floor formed by plates 46, 47 at the uppermost level in drier 20. The members 63 continue their downward movement as does skid 63*x* which retains limit switch 69*y* engaged with contact 69*z* until the members 63 and skid 63*x* are in the position illustrated in FIG. 10. In this position, switch 16 is still closed and skid 63*x* has moved to disengage from uppermost switch 69*x* so that limit 69*x* reengages with contact 69*y* whereupon the circuit to motor 66 is now interrupted at level 1 and plates 46, 47 pivot open. Since the skid 63*x* has moved to engage the next lower limit switch 69 to close it and since the next lower pressure switch 60 is closed the skids 63*x* continue their movement and the crank arms on members 31 function to move plates 46 and 47 to form a floor below the uppermost level 1. Thus when plates 46, 47 open, the grain from the next bin is dumped from the floor formed at level 1 on the next lower floor level which now has been formed in the drier as shown in FIG. 10.

Figure 11:
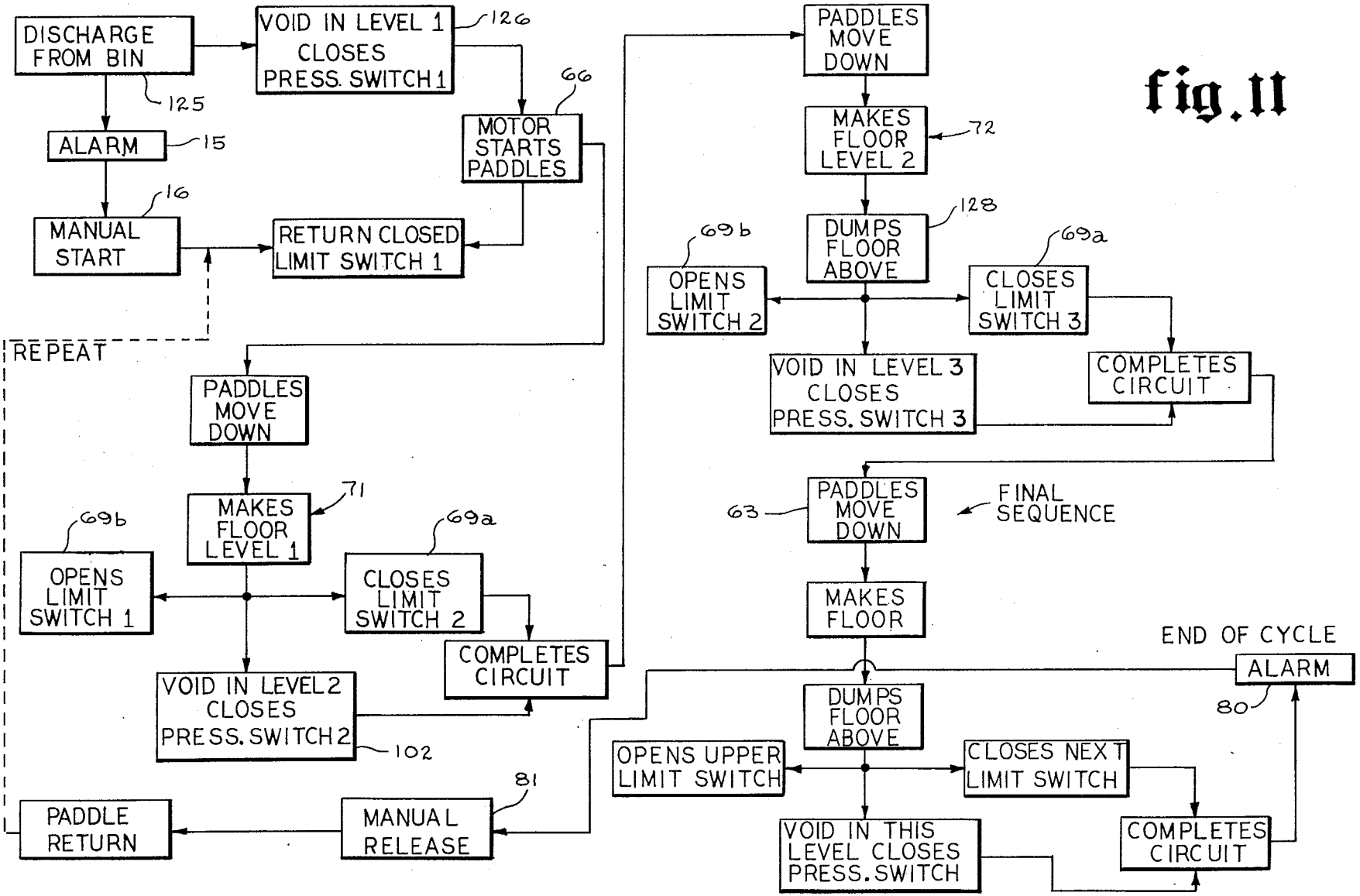
FIG. 11 is a block diagram illustrating the stepwise actuation of the present invention.

This portion of the operation is illustrated in the schematic drawing FIG. 11 wherein the discharge from the bin A is referred to at 125 and wherein the alarm which sounds when the discharge from the bin designated A has been completed is referred to at 15. When this occurs the operator may press the manual start button referred to by the numeral 16 in FIGS. 10 and 11 which closes the circuit to the limit switches 69 in the drier 20; however, all of the members 31 in the drier 20 retain the relationship shown in FIG. 3 until the grain has been discharged from immediately beneath the first or uppermost row 32 of members 31 and off the uppermost pressure switch 60 (level 1), and when this occurs the pressure switch 60 in the level 1 (the uppermost level) closes and manual switch 16 is closed to complete the circuit to the uppermost double throw limit switch 69x shown at the upper right top of FIG. 10 as described above.

To further amplify, with the uppermost or any subsequent pressure switch 60 and a limit switch 69*b* closed, the circuit is complete and the motor 66 functions to continue movement of the members 63 and skid 63*x* downwardly to engage the cranks 51 and 52 on one of the rows 32 in drier 20. As the members 63 move down, the end 63*g* will engage one of the crank arms such as the crank arm 51 mounted on the plate 46 and the other surface 63*e* will engage the other crank arm 52 mounted on the plate 47 so as to progressively move the plate 46 from the position 46*a* shown in dotted line in FIG. 6 to the position 46*b* shown in FIG. 6. As previously mentioned a member 63 is provided for engaging with the crank arms 51 and 52 on each of the plates 46 and 47 on each of the members 38 in a row 32 so that they will all be pivoted simultaneously in the direction represented by the arrows at 70 in FIG. 7. The width or extent of the members of 46 and 47 is such that they will engage or overlap the next adjacent member 47 or 46 as illustrated in FIGS. 6 and 7 thus forming a floor or deck extending horizontally across the drier 20 at level 1, which floor may be referred to generally by the numeral 71 in the diagram, FIG. 11. Also skid 63*x* moves limit switch 69*b* to engage contact 69*z*.

When the floor or deck as been formed above the charge of grain from the bin A moving through the drier 20, grain from bin C may then be discharged into the drier 20 so that it will collect on the floor 71 formed at the upper end of the drier in level 1.

The movement of the members or paddles 63 and skid 63*x* continues downwardly relative to drier 20 and they will maintain the floor 71 in position by reason of cranks 51 and 52 engaging longitudinal edges 63*a* and 63*b* of the members 63. The skid 63*x* contacts the next lowermost limit switch arranged adjacent the next lowermost row 32 of members 31 which may be designated level 2 so as to close such limit switch as schematically illustrated at 69*a* in FIG. 10 of the drawings.

The timing of the movement of the members or paddle 63 relative to the movement of the grain (from the bin A) through drier 20 is such that by the time the skid 63*x* is in position to contact the next adjacent lowermost limit switch 69, the space in the next lowermost level (level 2) of the drier immediately below level 1 adjacent the top of the drier 20 will be void, or that is, all grain will have been discharged downwardly therefrom so that the pressure sensitive switch in such space at level 2 will be closed as shown in FIG. 10. The skid 63*x* contacts and closes the next lower limit switches 69 as represented at 69*a* in FIG. 10, and with pressure switch 60 in level 2 closed, the circuit to motor 66 is still closed and a floor is formed by members 46 and 47 by engagement with the edges 63*a* and 63*b* of member 63. When this has occurred, the skid 63*x* disengages from the limit switch 69*x* in level 1 immediately above level 2 to enable the limit switch 69*x* to engage contact 69*y* as diagrammatically represented at 69*b* in FIG. 10.

When this occurs the portion of the circuit referred to generally at 75 will take over the movement of the members 63 and skid 63*x*. In FIG. 10 this circuit is shown in the position so that the next adjacent floor or deck as represented generally at 72 has been formed in the drier to separate the charge of grain from bin C from the grain in bin A which is continuing to move through the dryer beneath floor 72.

When the portion of the circuit 75 is closed so that floor 72 is formed as illustrated in FIG. 10, the limit switch 69*x*, as represented at 69*b*, opens the circuit to motor 66 and pressure switch 60 immediately beneath the uppermost row 32 (level 1) in the drier 20 will be open due to the weight of grain on the floor represented at 72 to the top of the drier 20 and being discharged thereinto from the bin C. Also, the members 63 will have disengaged from the cranks 51 and 52 on plates 46 and 47 in level 1 so that the springs 48 move them inside of the housing 38 to not interfere with grain movement from bin C through drier 20.

The sequential downward movement of the members 63 and skid 63*x* to engage and close the next lower limit switch 69 and the absence of grain on a pressure switch 60 at each row level, causes the circuit to motor 66 to remain closed to cause members 63 to move downwardly of the drier 20. This in turn causes the members 63 to sequentially contact and then disengage the limit switchs 69 as is the opening and closing of the pressure switches 60 in response to the presence or lack of grain immediately thereabove so that continuous movement of the paddles 63 is effected to sequentially form a floor to separate the charge of grain therebeneath from the charge of grain thereabove and to then open the next uppermost floor so that the grain can be charged or dropped onto such next lowermost floor to thereby maintain the charges of grain separate as they move through the drier 20.

Attention is now directed to the schematic flow diagram of FIG. 11. The discharge from the bin to the drier is represented by the numeral 125. When the discharge from any bin, such as bin A, then bin C, etc., has been accomplished, an alarm represented at 15 in FIG. 11 sounds. The level of the grain in any bin such as represented at 125 may be instrumentally noted so that when it is empty the alarm 15 can be sounded by means well known in the art.

At this time the operator presses the manual start button represented at 16, and the members 63 are positioned relative to the limit switch in level 1 so that it will be closed. When the grain in the drier has moved downwardly sufficiently so that there is a void in level 1 and no weight exerted on the pressure switch 60 in level 1 such lack of pressure enables the pressure switch to close as represented at 126 in FIG. 11 thus completing the circuit to the motor represented at 66. This along with closing switch 16 starts the paddles or members downwardly relative to the rows 32 of members 31 so as to engage sequentially the crank arms 51, 52 of the plates 46 and 47 in each row. Initially the movement of the member 63 downwardly forms a floor at level 1 represented at 71 in FIG. 11. When this occurs the operator may start the flow from another bin into the drier with the assurance that such charge of grain will be separated from the charge of grain presently in the drier.

As the paddles 63 continue to move downwardly, the skid 63*x* will next contact the adjacent limit switch 69 and close it as represented at 69*a* in FIGS. 10 and 11, and as previously noted the rate of movement of the paddles 63 relative to the movement of the grain beneath the initially formed floor 71 in level 1 will be such that when the skid 63*x* contacts and closes the next lower limit switch as represented at 69*a* to form the next lower floor 72 at level 2, such level will be void so that the pressure 60 immediately beneath such floor will be closed and this completes the circuit so that the floor in level 2 is formed. This is represented at 72 in FIG. 11 and after the floor 72 has been formed limit switch 69 adjacent level 1 will be opened as represented at 69*b* in FIGS. 10 and 11. Also the member 63 will have moved down sufficiently to disengage from cranks 51 and 52 so that the plates 46 and 47 pivot inwardly to dump the floor from level 1, or from the floor immediately above the closed floor as the paddle members 63 move continuously longitudinally of the drier 20. The dumping of the floor immediately above the closed floor is represented by the numeral 128 in FIG. 11.

Continued movement of the members 63 retains the floor level 72 formed until the grain therebeneath from the previous charge has moved down sufficiently in the drier so that the next pressure switch is exposed to a void whereupon the pressure switch closes and when the skid 63*x* contacts the limit switch adjacent such void, the limit switch will close, thereby closing the circuit so that the next lowermost floor is formed in the drier.

The closing of the next floor limit switch is represented in FIG. 11 as closing limit switch 3 and by the reference numeral 69*a*, whereupon the limit switch thereabove is disengaged from the skid 63*x* and also the paddles disengage from the cranks 51 and 52 to enable the plates 46 and 47 to pivotally move inwardly of the housing 43 so as to not interfere with the downward movement of the grain in the drier.

Such sequential operation is continued until the paddle members 63 move to the lower end of the drier as represented at 80 in FIG. 8 whereupon a switch is contacted to sound the alarm, the switch and the alarm being referred to as a combination at 80 in FIG. 11.

Thereafter a manual release button may be pushed as at 81 so as to close the circuit 75 through contact 69*y* to motor 66 to move the members 63 and skid 63*x* upwardly by means of the motor 66 and chain 64 to position them adjacent level 1 and to engage 69*x* and contact it with 69*z*. Since there is always normally grain on the uppermost level when paddles 63 are in such position, adjacent pressure switch 60 is open and this stops the movement of members 63 until the grain at such level has again moved down the drier. At this time the members 31 in the drier 20 are in the position shown in FIG. 3 so that after the second bin has been completely emptied into the drier, grain from still another bin may be dumped into the drier immediately therebehind and supported on the sequentially formed floors as such charge is moved through the drier.

From the foregoing, it can be appreciated that the drier remains continuously in operation with different charges of grain moving therethrough in a segregated manner while being dried.

It should also be noted by referring to FIG. 3 of the drawings that the members 31 in the rows 32 are aligned vertically so that the paddles 63 may engage the cranks 51 and 52 to move the plates 46 and 47 to form the floors as described.

Similarly, it will be noted that the members 34 in the rows 33 are offset horizontally relative to the members in the rows 31 to aid in causing the grain to move through the drier in a manner so that it be more intimately contacted by the air from the plenum as such air is discharged through the members 31 and 33 in a manner as described herein for drying of the grain.

Figure 12:
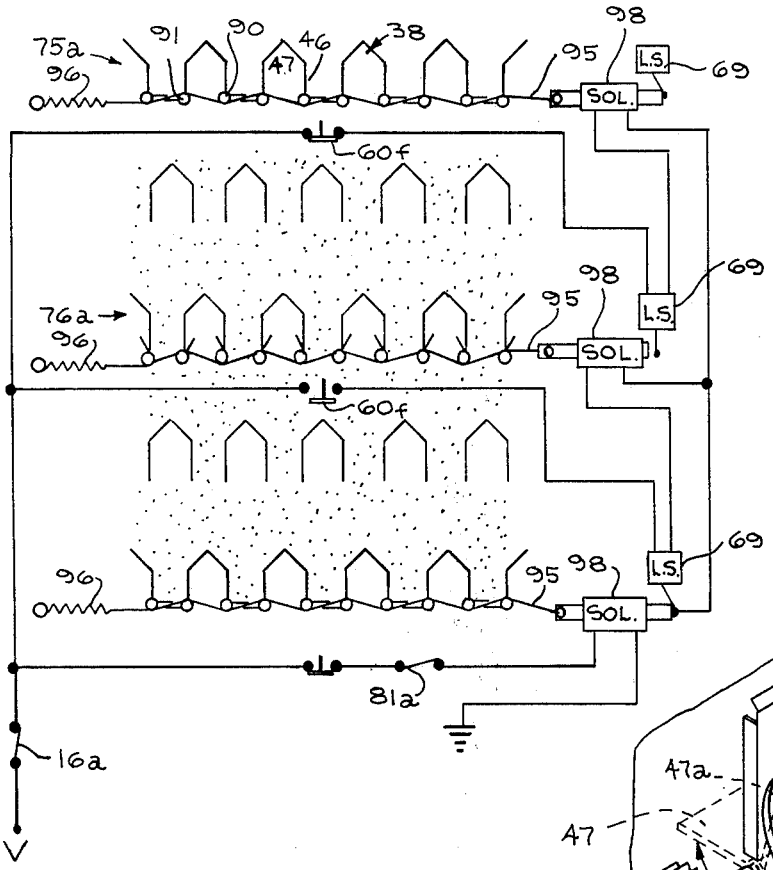
FIG. 12 illustrates an alternate arrangement for actuation of the present invention.
Figure 13:
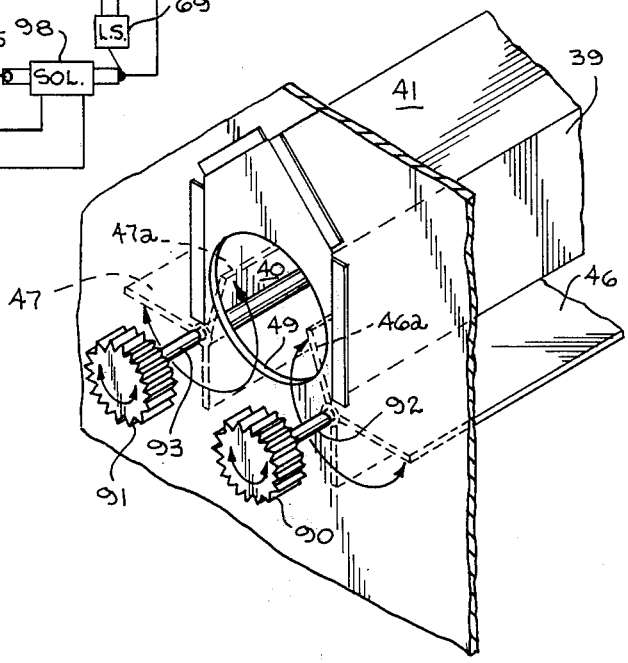
FIG. 13 is a fragmentary elevational view illustrating in greater detail part of the arrangement of FIG. 12.

FIGS. 12 and 13 show an alternate form, or arrangement of sequentially forming floors in the drier.

When grain has been discharged from a bin into a drier with the FIG. 12 and 13 modification an alarm 15 again sounds. The operator presses the manual start button 16*a* in FIG. 12 and also closes the manual release switch 81*a* at the beginning of the cycle. It can be appreciated that at this time grain is passing down through the drier and being discharged therefrom, such grain having been discharged into the drier from a bin. When the grain in the drier 20 is off the uppermost pressure switch referred to at 60*f* in FIG. 12, the circuit referred to at 75*a* is closed or completed to solenoid 98 causing it to retract and pull chain 95 against the tension of the spring 96 to which the other end of the chain 95 is connected. Such movement of the chain 95 causes the sprockets 90 and 91 illustrated in FIGS. 12 and 13 to rotate and to move the plates 46 and 47 from the position shown at 46*a*, 47*a* in FIG. 13 to the horizontal position shown in FIG. 13 to form a floor in level 1 in the drier.

Grain from another bin, such as bin C can now be fed to the drier 20 without danger of mixing with the grain from a previous bin such as bin A. As the grain from bin A moves down through the drier 20, it will move below the level of the next lowermost pressure switch 60*f*, thus releasing the pressure from the pressure switch 60*f* so as to complete the circuit referred to by the numeral 76*a* to the next lowermost solenoid below level 1 (level 2) and cause such solenoid in level 2 to move chain 95 against the force of spring 96 and rotate the sprockets 90 and 91 to move the plates 46 and 47 to form a floor immediately beneath the floor thereabove.

After the floor immediately below level 1 has been formed, the position of the solenoid in level 2 relative to adjacent the limit switch 69 shown in FIG. 12 is such that it will engage such limit switch and open the circuit to the solenoid 98 immediately thereabove in level 1 whereupon the spring 96 causes the chain 95 to move in a reverse direction and thereby move the plates 46 and 47 to the position shown at 46*a*, 47*a* in FIG. 12 so that the grain is then dumped onto the next lowermost formed floor in the drier, level 2.

This sequence is continued until all of the grain has been discharged into the drier 20 from bin C, whereupon it is repeated as grain from another bin is to be placed in the drier after the drier floor is formed at level 1 to receive a charge from such other bin.

Only three floors, or rows are illustrated in FIG. 12, although there may be any number. The rows 33 have been schematically shown in FIG. 12. Assuming that the bottom row shown in FIG. 12 is at the lower end of a drier 20, switches 81*a* and 16*a* are closed when a floor is formed with grain thereon. To discharge this grain from bin C (now in the drier) to bin D, switch 81*a* is manually opened and this opens the circuit for only the lowermost solenoid and opens the bottom floor for the grain to discharge to bin D. Switch 81*a* may thereafter be closed and the cycle repeated.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for separating loads of material as the material moves through a vertical drier comprising:

a. a plurality of members aligned in side by side, horizontal relation to form a plurality of horizontal longitudinally arranged rows in a vertical drier;

b. movable means associated with said members to form a floor to separate one part of the drier from another part;

c. means to actuate said movable means in a predetermined sequence to stepwise form a floor from the top to the bottom of the drier and thus seqentially open the floors from the top to the bottom of the drier to progressively move the material through the drier while simultaneously maintaining separate loads of material segregated as they progressively move through the drier;

d. said movable means including:

1. plates pivotally secured to each side of said members;
2. spring means normally retaining said plates in retracted position to enable material to flow around the members in the drier; and
3. rotatable means connected to said plates and rotatable to move said plates into horizontal relation to engage with said next adjacent plates of said members aligned in side by side relation to thereby form a floor in the drier.

2. The invention of claim 1 wherein said movable means includes:

a. plates pivotally secured to each side of said members;

b. spring means normally retaining said plates in retracted position to enable material to flow around the members in the drier; and c. rotatable means connected to said plates and rotatable to move said plates into horizontal relation to engage with said next adjacent plates of said members aligned in side by side relation to thereby form a floor in the drier.

3. The invention of claim 1 wherein said rotatable means comprises a crank lever.

4. The invention of claim 3 wherein said actuating means comprises:

a. an electrical circuit said circuit including:

1. motor means;
2. switch means normally open when material is thereon, and movable to closed position in the absence of material;
3. limit switch means adjacent each of said horizontal longitudinally spaced rows; and
4. manually operable switch means;

b. movable means responsive upon closing said circuit when switch means (2), (3) and (4) closes to move into engagement with said rotatable means and move said plates of said members aligned in side by side relation to form a floor in the drier.

5. The invention of claim 4 wherein said switch means (2) is arranged immediately beneath each row of members aligned in side by side relation to form a floor in the drier and wherein said movable means upon contacting the next lower limit switch means adjacent a row actuates said electrical circuit to form another floor in the drier, said movable means then disengaging from the limit switch adjacent the row immediately thereby to open the circuit and disengage said movable means from said rotatable means whereupon said spring means brings said plates to retracted position.

6. The invention of claim 4 wherein said electrical circuit includes a solenoid and wherein said movable means is actuated by said solenoid to rotate said rotatable means to move said plates and form a floor.

7. The invention of claim 5 wherein each row of aligned members is provided with a movable means connected to a solenoid and wherein the solenoid remains activated to form the floor in the drier until the next lower solenoid has been actuated whereupon it engages said limit switch adjacent said row and deactivates said solenoid immediately thereabove.

8. The invention of claim 4 wherein said movable means includes paddle members to engage and rotate said crank lever of each of said rotatable means.

9. The invention of claim 8 wherein said movable means includes skid means movable simultaneously with said paddle members whereby said skid means sequentially engages said limit switch means to form a floor by said rotatable means and then open the floor immediately thereabove.

* * * * *

UNITED STATES PATENT AND TRADEMARK OFFICE

CERTIFICATE OF CORRECTION

PATENT NO. : 3,986,270

DATED : October 19, 1976

INVENTOR(S) : HENRY E. KYLE, JR.

It is certified that error appears in the above-identified patent and that said Letters Patent are hereby corrected as shown below:

Col. 2, line 58, "driver" should be --drier--

Col. 6, line 58, after "of" insert --members or--

Col. 7, line 63, after "below" delete --the--

Col. 8, line 22, "anther" should be --another--

Col. 8, line 30, after "limit" insert --switch--

Signed and Sealed this

Fourth Day of January 1977

[SEAL]

*Attest:*

RUTH C. MASON
*Attesting Officer*

C. MARSHALL DANN
*Commissioner of Patents and Trademarks*